United States Patent [19]

Shofu

[11] 4,184,194

[45] Jan. 15, 1980

[54] SELF-ENERGIZED PORTABLE HIGH DENSITY LIGHT DISPLAY UNIT

[76] Inventor: Koichi Shofu, 13910 Northwest Passage, #304, Marina Del Rey, Calif. 90291

[21] Appl. No.: 918,348

[22] Filed: Jun. 23, 1978

[51] Int. Cl.[2] ..... G09F 13/04

[52] U.S. Cl. ..... 362/97; 362/184; 362/260; 362/311

[58] Field of Search ..... 362/223, 97, 260, 33, 362/311, 184

[56] References Cited

U.S. PATENT DOCUMENTS

| | | | |
|---|---|---|---|
| 2,629,043 | 2/1953 | Holtje | 362/97 X |
| 3,356,839 | 12/1967 | Mehess et al. | 362/97 X |
| 4,071,883 | 1/1978 | Dennis | 362/97 |

*Primary Examiner*—Stephen J. Lechert, Jr.
*Attorney, Agent, or Firm*—Keith D. Beecher

[57] ABSTRACT

A self-energized portable high intensity light display unit is provided for displaying transparencies such as X-ray films, photographic films, and the like. The unit includes a casing having rolled-over sides which serve as housings for a number of batteries and for a circuit board, a reflective panel extending across the casing and supporting three fluorescent lamps in spaced parallel relationship, a translucent panel supported above the fluorescent tubes, and a pair of end members which serve to hold all of the aforementioned components in an assembled condition and which serve as interconnects for the batteries. The circuit board serves to convert a 12-volt battery voltage into 20–25 KHz alternating current voltage at 800–1000 volts. The fluorescent lamps are connected in series. A relay initially connects two of the lamps in series across the alternating current voltage when the unit is first turned on until they are started, and then the relay connects the third lamp in series with the other two across the alternating current voltage. The result is a simple and inexpensive high intensity display unit of low current drain.

2 Claims, 3 Drawing Figures

SELF-ENERGIZED PORTABLE HIGH DENSITY LIGHT DISPLAY UNIT

SUMMARY OF THE INVENTION

As stated above, the present invention provides a simple, economical and compact light display unit which is entirely self-contained, and which is capable of producing high intensity light with low battery drain. The unit of the invention has a multitude of uses. For example, as suggested above, it may be used to display photographic or X-ray films, or other transparencies. It may also be used for observation and photography in laboratories, and wherever a uniform planar light source is required. The unit is safe because the batteries are automatically disconnected when either end member is removed to dis-assemble the unit.

DETAILED DESCRIPTION OF THE ILLUSTRATED EMBODIMENT

Figure 1:
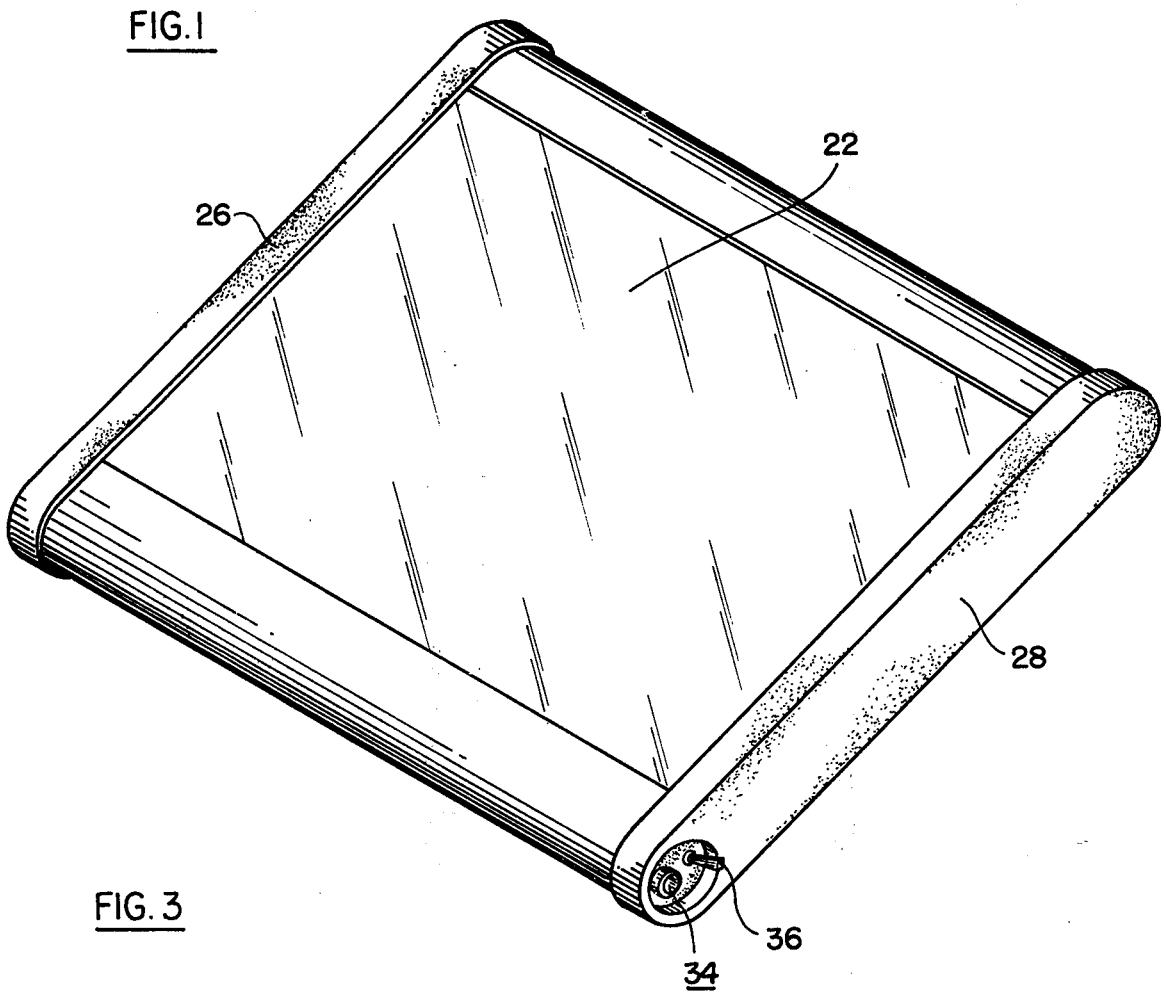
FIG. 1 is a perspective view of a light display unit representative of one embodiment of the invenion.
Figure 2:
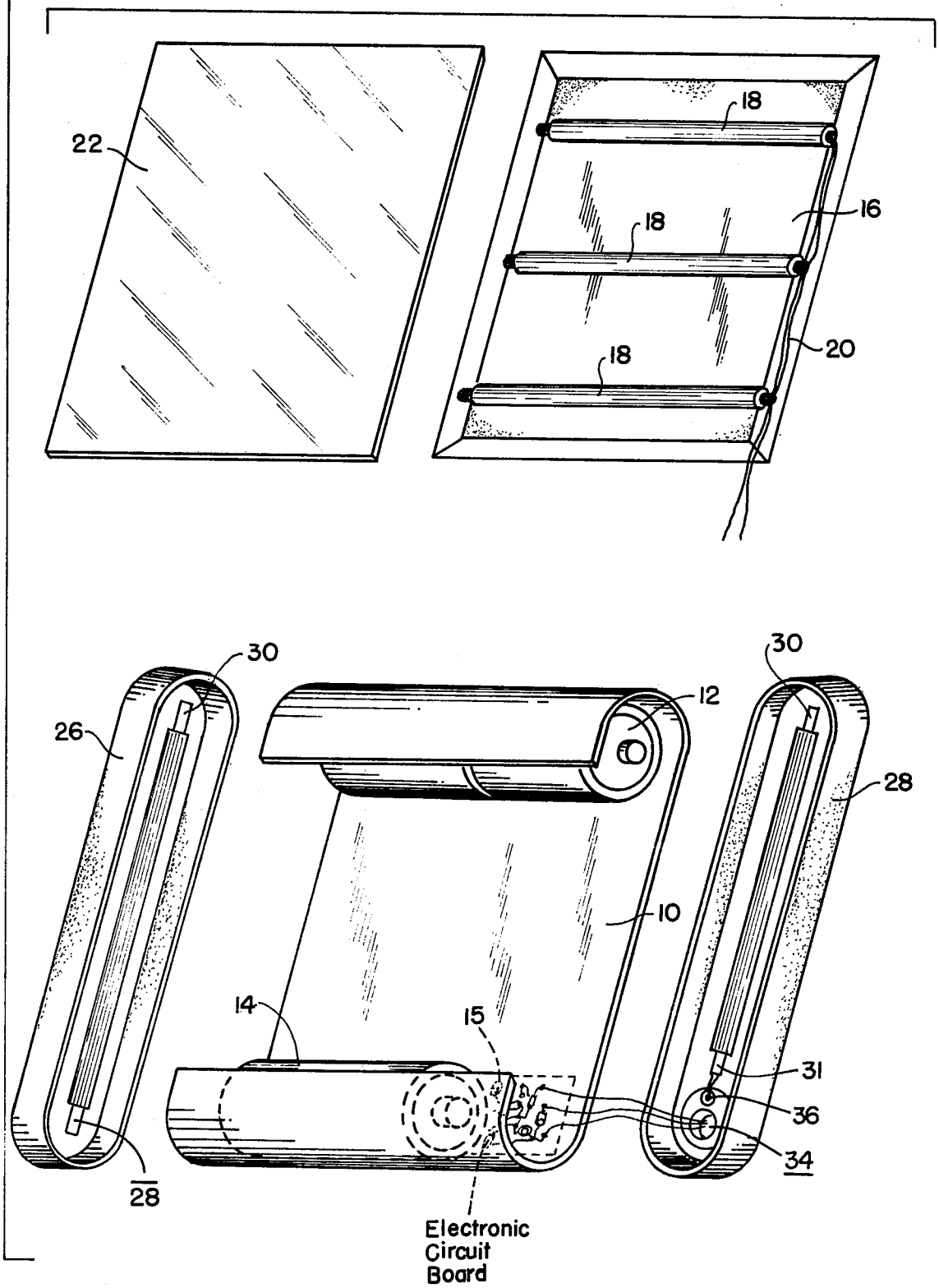
FIG. 2 is a perspective exploded view of the components of the light display unit of FIG. 1.

The light display unit of the invention, as shown in FIGS. 1 and 2 includes a metallic casing 10 which has rolled-over sides which, in turn, form housings for a plurality of batteries 12 and 14. A circuit board 15 is also positioned on casing 10 in one of the housings formed by the rolled-over sides of the casing. A light reflective panel 16 is supported on the casing, and extends across the open top of the casing. Three fluorescent lamps 18 are supported on the reflective panel 16, and extend across the panel in spaced and parallel relationship. The lamps are connected to the circuitry on circuit board 15 by wires, such as the wires 20. More or less fluorescent lamps may be used.

A translucent panel 22 is positioned on the casing 10 over the reflective panel 16, and over the fluorescent tubes 18. The translucent panel 22 forms the planar light source of the display unit, and film transparencies, and the like, which are to be viewed, are placed over the top of the translucent panel 22.

The components of the light unit are held together by a pair of end members 26 and 28. The end members fit over the ends of the casing 10, in frictional engagement, and over the edges of the translucent panel 22, as best shown in FIG. 1, so that all the components of the light display unit are held in assembled condition by the end members.

A switch 36 is mounted on end member 28, and is connected to the circuit board 15, by wires 32. A plug 34 is also mounted on the end member 34, and a appropriate direct current voltage source may be connected to the unit through the plug 34 to re-charge the batteries 12 and 14.

Conductive strips 30 and 31 are mounted on the inner surfaces of the respective end members 26 and 28, and these strips serve to interconnect the batteries 12 and 14 into a desired series relationship, and to connect the batteries through switch 36 to the circuit board 15.

Figure 3:
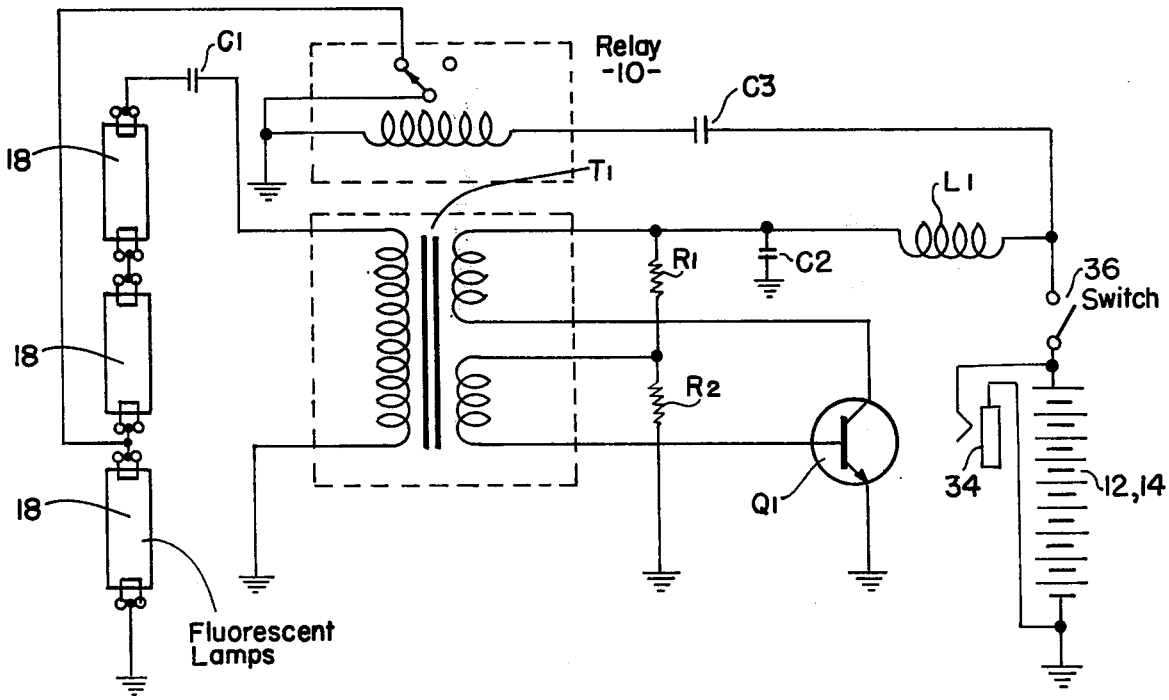
FIG. 3 is a circuit diagram of the circuitry incorporated in the light display unit.

The circuitry of the circuit board 15 is shown, for example, in FIG. 3. As shown in FIG. 3, the batteries 12 and 14 are connected between switch 36 and ground, the batteries being connected in series, as explained above. The jack 34 is connected across the batteries, so that a source of charging direct current may be plugged into the jack.

The switch 36 is connected to an inductance coil L1, and to a capacitor C3. Capacitor C3 may, for example, have a capacitance of 1000 microfarads. Inductance L1 is connected to a grounded capacitor C2 having a capacity of 220 microfarads, and to a first winding of a transformer T1. The first winding is also connected to the collector of a transistor Q1, which may an NPN transistor of the type designated HEP5004. The emitter of transistor Q1 is grounded, and the base is connected to a second winding of transformer T1.

A resistor R1 is connected to the first and second windings, and to a grounded resistor R2. Resistor R1 may have a resistance of 1 kilo-ohm and resistance R2 may have a resistance of 47 ohms.

The third winding of transformer T1 is connected to ground, and through a capacitor C1 to one of the fluorescent lamps 18. Capacitor C1 may have a capacitor of 180 picofarads. The three fluorescent lamps 18 are connected in series from capacitor C1 to ground.

Capacitor C3 is also connected to the energizing winding of a relay 10. The relay winding is also connected to ground, and to a movable contact. One of the fixed contacts of the relay 10 is connected to the junction of two of the fluorescent lamps, as shown. Capacitor C3 operates as a time delay for relay 10.

The circuit of transistor Q1 is an oscillator which oscillates at the desired frequency, so that the battery voltage from batteries 12, 14 may be converted to a high frequency alternating current voltage, as explained above. Transformer T1 serves to step up the voltage of the alternating current voltage to a desired high value to energize the fluorescent.

When switch 36 is first closed, the circuit of transistor Q1 oscillates, and a high alternating current voltage is introduced across the upper two fluorescent lamps 18. At this time, the contact of relay 10 places a ground on the junction between the lower two fluorescent lamps 18, so that only two of the lamps are connected across the transformer T1. Therefore, a relatively high voltage in introduced to the lamps for starting purposes, so that the need for a separate ballast starter is obviated.

After a particular time, capacitor C3 charges up and relay 10 is energized, thereby opening the connection between the junction of the two lower fluorescent lamps 18 and ground. Therefore, all three lamps are now placed across the transformer T1, and all three become energized.

The invention provides, therefore, a simple and inexpensive self-contained high intensity light display unit. The unit has a variety of purposes. Moreover, it is easy to operate.

It will be appreciated that although a particular embodiment of the invention has been shown and described, modifications may be made. It is intended in the claims to cover the modifications which come within the spirit and scope of the invention.

What is claimed is:

1. A light display unit comprising: a casing having an open top and forming battery housings along at least one side thereof; a circuit board position in said casing; a reflective panel positioned in said casing and extending across the open top; a translucent panel mounted over the reflective panel and extending across the open top of the casing; a plurality of fluorescent tubes mounted on said reflective panel under said translucent panel and connected to said circuit board, said circuit board including converter circuitry for converting a relatively low direct current battery voltage to a relatively high alternating current voltage for energizing the fluorescent tubes; a switch connected to said circuitry, and said circuit board including a relay for connecting some of said fluorescent tubes in series across the alternating current voltage when the switch is first turned on, and for subsequently connecting all of said fluorescent tubes in series across said alternating current voltage; and a pair of end members serving to hold the aforementioned components of the display unit together.

2. The light display unit defined in claim 1, in which the casing has rolled-over sides forming battery housings at each side of said casing, and said end members include resilient conductive strips mounted on the inner surfaces thereof to interconnect batteries in said battery housings.

* * * * *